US006666731B2

(12) United States Patent
Zweigle et al.

(10) Patent No.: US 6,666,731 B2
(45) Date of Patent: Dec. 23, 2003

(54) SECONDARY LOCK FOR A CABLE HARNESS PLUG HAVING DIFFERENT TYPES OF CONTACTS

(75) Inventors: Peter Zweigle, Ditzingen (DE); Markus Lux, Waiblingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/199,386

(22) Filed: Jul. 19, 2002

(65) Prior Publication Data

US 2003/0032340 A1 Feb. 13, 2003

(30) Foreign Application Priority Data

Jul. 19, 2001 (DE) ..... 201 11 964U

(51) Int. Cl.[7] ..... H01R 13/514
(52) U.S. Cl. ..... 439/752
(58) Field of Search ..... 439/752, 733.1, 439/744, 745, 746, 747, 748, 749, 595

(56) References Cited

U.S. PATENT DOCUMENTS 5,575,692 A * 11/1996 Cecil, Jr. et al. ..... 439/752
5,586,917 A * 12/1996 Yagi et al. ..... 439/752
6,050,861 A * 4/2000 Genta et al. ..... 439/752
6,264,497 B1 * 7/2001 Murakami et al. ..... 439/417
6,368,164 B1 * 4/2002 Nakamura ..... 439/752
6,409,552 B2 * 6/2002 Matsumoto ..... 439/752

* cited by examiner

*Primary Examiner*—Ross Gushi
(74) *Attorney, Agent, or Firm*—Kenyon & Kenyon

(57) ABSTRACT

A cable harness plug for establishing an electric connection to a plug strip. The cable harness plug includes a housing, contact elements arranged in the housing and at least one lock. The cable harness plug includes at least two different types of contacts, and a lock is assigned to each type of contact. A lock includes at least one locking plate covering at least one area of one type of contact and includes a locking element which, by insertion into cable harness plug, converts locking plate to the locked position in the one area of type of contact and at the same time activates the lock which is assigned to the other types of contacts. This allows for production of secondary lock for different types of contacts of a cable harness plug simultaneously by using a single locking element.

11 Claims, 4 Drawing Sheets

SECONDARY LOCK FOR A CABLE HARNESS PLUG HAVING DIFFERENT TYPES OF CONTACTS

FIELD OF THE INVENTION

The present invention relates to a cable harness plug for establishing an electric connection to a plug strip, including a housing, contact elements arranged in the housing and at least one lock, the cable harness plug including at least two different types of contacts, and a lock assigned to each type of contact, and a secondary lock for a cable harness plug of the type defined above.

BACKGROUND INFORMATION

Cable harness plugs of the type defined above may include a housing with a contact strip. The contact strip in turn includes contact elements which cooperate electrically with contact elements of a plug strip.

Cable harness plugs may also include different areas of contact elements, in particular when a cable harness plug is used to establish an electric connection in low as well as high power ranges.

In the case of a first type of contact, a contact is arranged in a chamber for establishing an electric connection to a contact element in such a manner that spring-like latch arms, which are arranged inside the contact strip, are pressed in the direction of the contact by insertion of a locking element and hold the contact in the chamber. The locking element may be inserted into the cable harness plug perpendicular to and opposite the direction of insertion of the cable harness plug. The guide elements provided on the latching element ensure that the latch arms are pressed in the direction of the contact.

With another type of contact, a contact is arranged in a chamber for establishing an electric connection to a contact element in such a manner that it is held in the chamber by a spring element mounted on the contact. A locking plate configured like a clamp is insertable perpendicular to the direction of plug insertion of the cable harness plug. In the locked position of this locking plate, the contact is surrounded in a clamping fashion and is thus also positioned in the correct position.

Due to the different configurations of contact elements, it is necessary to create a corresponding secondary lock which depends on the type of contact. It may be tedious and time-consuming to activate the secondary lock for each individual type of contact, depending on the position and arrangement of the lock. For this purpose, it may also be necessary to keep a supply of the corresponding components on hand. The injection molds for the cable harness plugs and the contact strips may be very complex in configuration and therefore cost intensive.

SUMMARY OF THE INVENTION

According to the exemplary embodiment of the present invention, secondary locking of at least two types of contacts or contact areas is provided by using one locking element. The lock includes at least one locking plate covering at least one area of one type of contact and including a locking element which, by insertion into the cable harness plug, converts the locking plate to the locked position in the one area of the type of contact and at the same time activates the lock which is assigned to the other types of contacts.

According to the exemplary embodiment of the present invention, simple operation, in particular of a secondary lock, is accomplished despite the fact that the cable harness plug includes different types of contacts.

Furthermore, due to the extraordinary retaining force of the exemplary locking plate according to the exemplary embodiment of the present invention, it is not necessary to include additional retaining elements for retaining and positioning contacts in the chambers of the contact strips.

According to the exemplary embodiment of the present invention, a secondary lock for a first type of contact is provided, its first part is composed of two locking plates which are movable back and forth within the cable harness plug in a direction perpendicular to the direction of insertion of the cable harness plug and which are lockable using an additional part, namely a locking element.

The locking plates are configured identically. They include recesses which in the locked state encompass contacts in the contact chambers. The individual locking plates overlap in the locked state. A large recess which is arranged centrally is necessary to establish the electric plug connection between the contact elements of the cable harness plug and the plug strip.

In one exemplary embodiment, the locking plates have a spring-like configuration which press the locking plates into their respective original positions, i.e., releasing the contacts. By insertion of the locking element, the two locking plates are converted to the locked position against the spring force.

DETAILED DESCRIPTION

Figure 1:
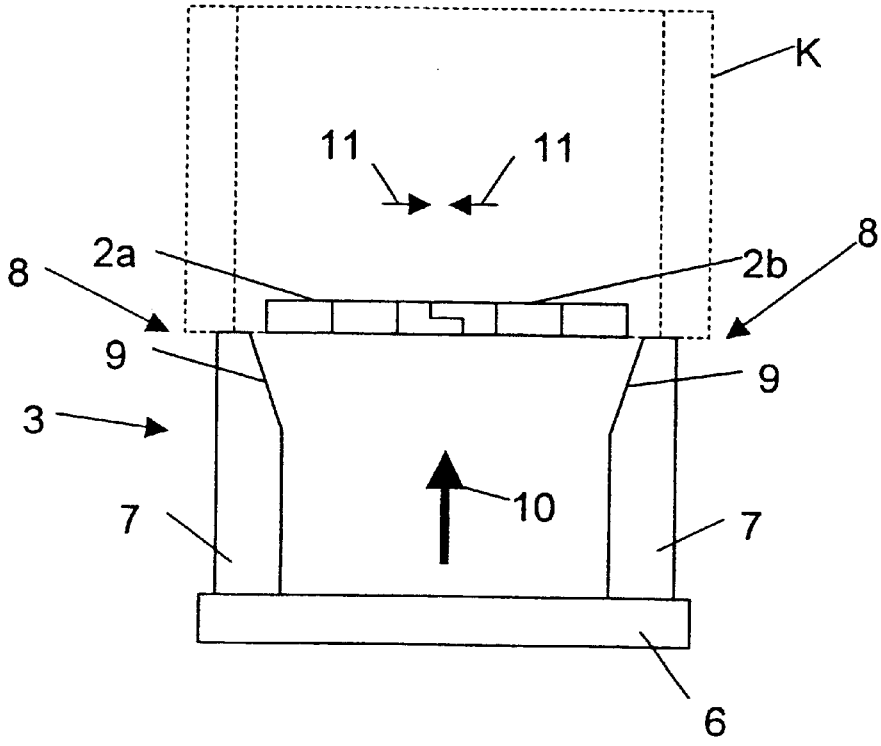
FIG. 1 shows a function diagram to illustrate the functioning of the secondary lock for a first type of contact.

FIG. 1 illustrates a exemplary secondary lock 1 according to the present invention for a first type of contact. This secondary lock 1 includes two locking plates 2*a,* 2*b* and a locking element 3.

Figure 2:
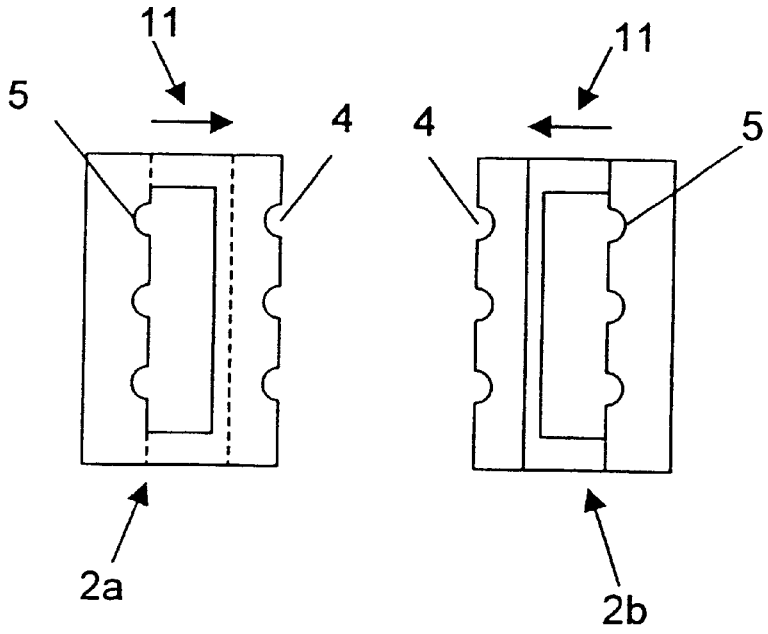
FIG. 2 shows a top view of the locking plates of one exemplary embodiment of a secondary lock for a cable harness plug including a first type of contact.

Locking plates 2*a* and 2*b,* shown on an enlarged scale in FIG. 2, include recesses 4 on their one outer edge. These recesses 4 cooperate with additional recesses 5 when locking plates 2*a,* 2*b* are in the locked state, as illustrated in FIG. 1. In this state, recesses 4, 5 extend around the contact elements arranged in chambers of a cable harness plug K. This ensures that the contact elements will be held in the correct position in the chambers.

To bring about the locked state, as illustrated in FIG. 1, locking element 3 are inserted into cable harness plug K.

This locking element 3 includes a bottom plate 6 and guide elements 7 protruding away from bottom plate 6 like pins. On their free ends 8, guide elements 7 include leading slopes 9 which cause locking plates 2*a* and 2*b* to move toward one another (direction of arrows 11) during insertion of locking element 3 into cable harness plug 1 (direction of arrow 10) and convert them to the locked state.

Figure 3:
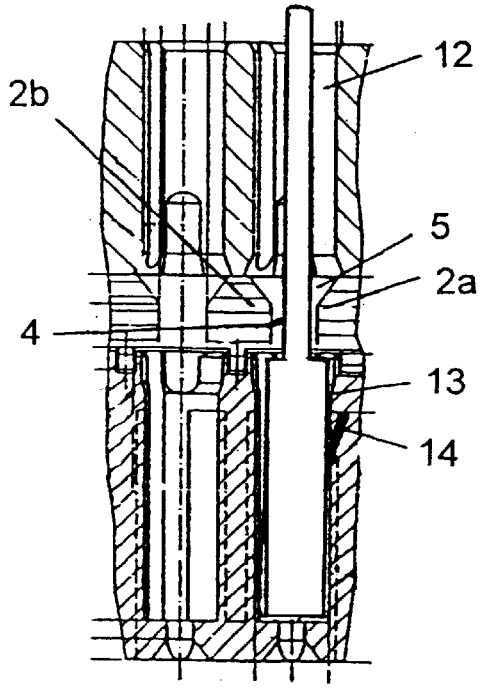
FIG. 3 shows a section through a contact chamber of a cable harness plug including a contact element according to a first type of contact.

FIG. 3 shows a contact chamber 12 including a contact 13 arranged in contact chamber 12. Contact 13 is held in the pre-assembly state by primary locking springs 14 in contact chamber 12. To establish the secondary locking, both locking plates 2*a,* 2*b* are pushed together so that contact 13 is surrounded by recesses 4, 5 of locking plates 2*a,* 2*b*.

Figure 4:
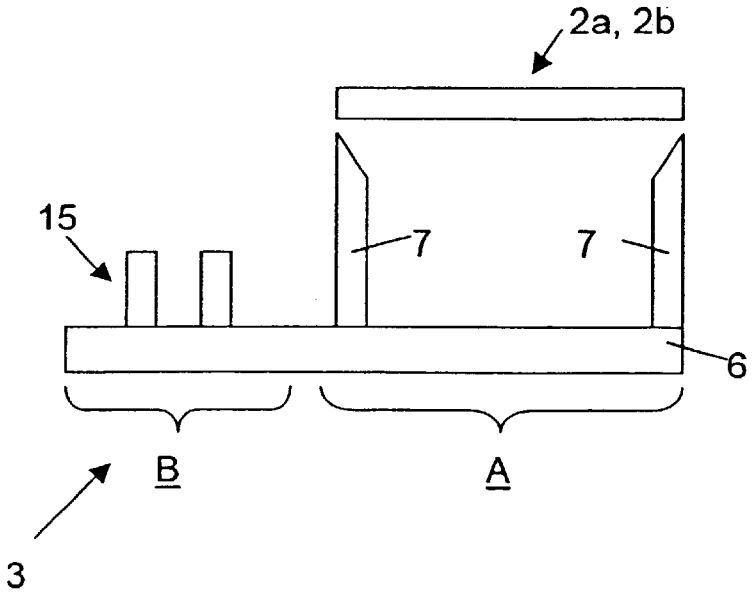
FIG. 4 shows a side view of a locking element as part of the exemplary secondary lock according to the present invention.
Figure 5:
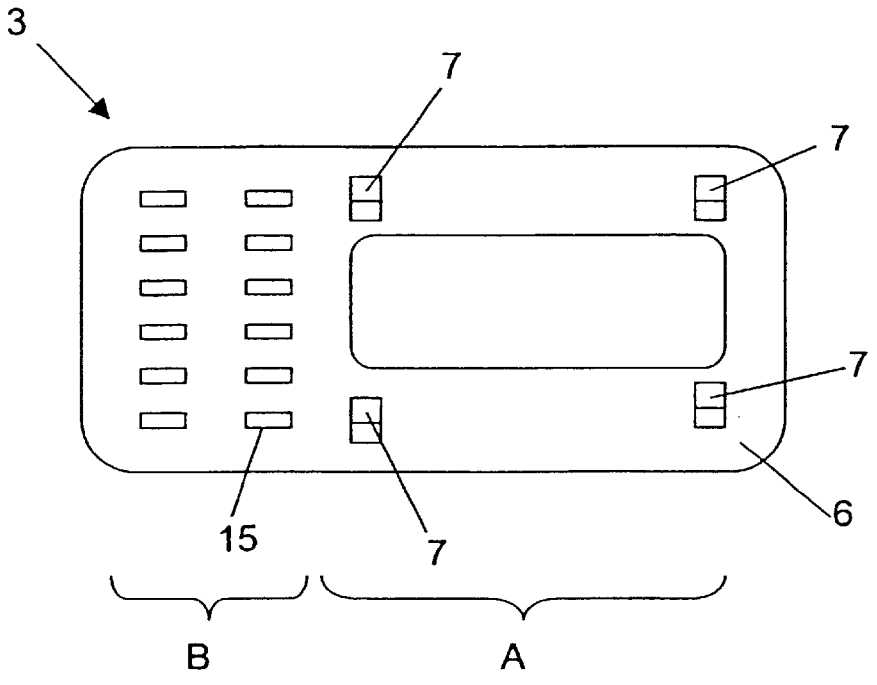
FIG. 5 shows a top view of the locking element according to FIG. 3.
Figure 6:
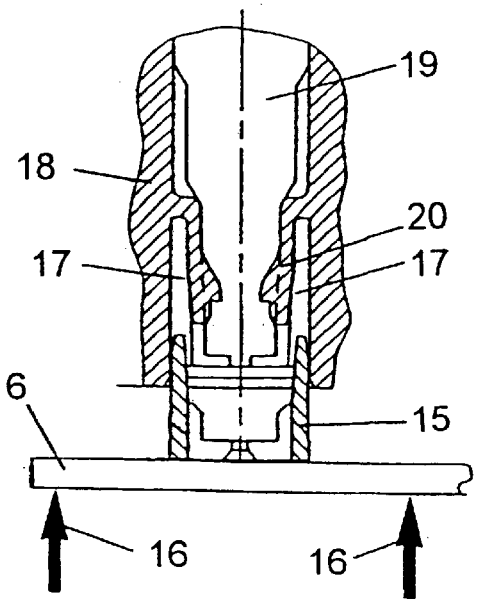
FIG. 6 shows a section through a contact chamber of a cable harness plug including a contact element according to an additional type of contact in the pre-assembly position.

Furthermore, clamp elements 15 (FIGS. 4, 5) are provided on bottom plate 6 and are used for locking another type of contact. Latch elements 20 are provided between recesses 17 and chamber 19. These latch elements 20 are displaced initially in the direction of recesses 17 by insertion of a contact 21 to be arranged in chamber 19, so that contact 21 may be pushed through. In a corresponding position, latch elements 20 engage behind contact 21 and hold it in chamber 19. To prevent this latch from being released again, clamp elements 15 are to be inserted into the recesses. Due to insertion of locking element 3 in direction of arrow 16 (FIG. 6), clamp elements 15 penetrate into recesses 17 which are provided on the side of a contact strip 18 in the area of respective chambers 19, blocking movement of latch elements 20 in the direction of recess 17. This secures the latching of contact 21 in chamber 19.

Figure 7:
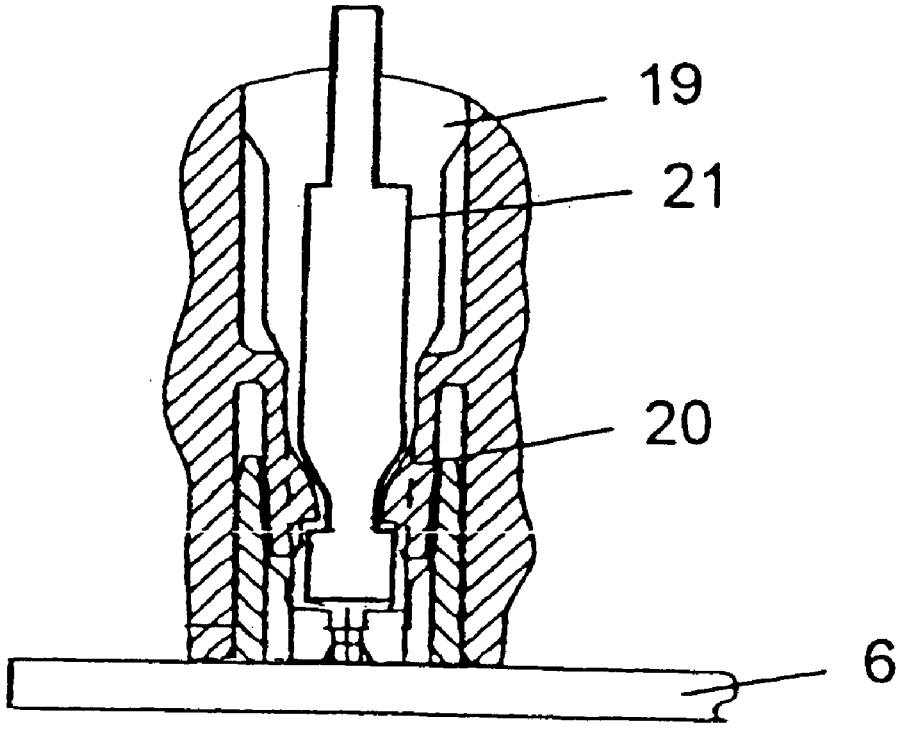
FIG. 7 shows a section through a contact chamber of a cable harness plug including a contact element according to an additional type of contact in the locked position.

FIG. 7 shows this latched position. The clamping effect of this device is so strong that the above-mentioned primary lock/primary locking spring 14 (FIG. 3) may be omitted.

Locking element 3 includes a corresponding number of clamp elements 15 and guide elements 7, depending on the configuration of the contact strip.

Due to the configuration of this secondary lock, the locking of elements is accomplished with a single locking element, the lock is assigned to different types of contacts.

What is claimed is:

1. A cable harness plug for establishing an electric connection to a plug strip, comprising:

a housing;

contact elements arranged in the housing, wherein there are at least two different types of contacts; and at least one lock assigned to each of the at least two different types of contacts, wherein the at least one lock includes at least one locking plate covering at least one area of one type of the at least two different types of contacts, and a locking element that is insertable into the cable harness plug to convert the at least one locking plate to a locked position in the at least one area and at the same time activates a lock of the at least one lock that is assigned to other types of the at least two different types of contacts.

2. The cable harness plug of claim 1, wherein the at least one locking plate includes a first part and a second part, each having recesses toward their respective sides, recesses of the first part cooperating with recesses of the second part of the at least one locking plate in a locked state and at least partially encompassing the at least two different types of contacts.

3. The cable harness plug of claim 1, wherein the locking element includes guide elements that are configured such that, by inserting the locking element into the cable harness plug, locking plates of the at least one locking plate are guided toward one another into a locked state, the locking plates being arranged displaceably in the cable harness plug.

4. The cable harness plug of claim 3, wherein guide elements are configured as pins and include leading slopes on their free ends that cooperate with the at least one locking plate when the locking element is inserted into the cable harness plug.

5. The cable harness plug of claim 1, further comprising:

spring elements arranged in the cable harness plug, wherein the locking element includes clamp elements that secure the spring elements for retaining contacts in a locked state of the at least one locking plate.

6. The cable harness plug of claim 1, wherein a lock of the at least one lock is a secondary lock of an electric plug connection.

7. The cable harness plug of claim 1, wherein the at least one locking plate is insertable into the cable harness plug in a direction perpendicular to an insertion direction of the cable harness plug.

8. The cable harness plug of claim 1, wherein the locking element is pushed in a perpendicular direction and pushed opposite a direction of plug insertion on a side of the cable harness plug facing the direction of plug insertion.

9. The cable harness plug of claim 1, wherein the at least one locking plate includes two locking plates.

10. The cable harness plug of claim 9, wherein the two locking plates are identical and are offset by 180° relative to one another in the cable harness plug.

11. A secondary lock for a cable harness plug for establishing an electric connection to a plug strip, the cable harness plug including a housing, contact elements arranged in the housing, wherein there are at least two different types of contacts, the secondary lock comprising:

at least one lock assigned to each of the at least two different types of contacts;

wherein the at least one lock includes at least one locking plate covering at least one area of one type of the at least two different types of contacts, and a locking element that is insertable into the cable harness plug to convert the at least one locking plate to a locked position in the at least one area and at the same time activates a lock of the at least one lock that is assigned to other types of the at least two different types of contacts.

* * * * *